US006729112B2

(12) United States Patent
Kuss et al.

(10) Patent No.: US 6,729,112 B2
(45) Date of Patent: May 4, 2004

(54) TUBULAR BAGGING MACHINE

(75) Inventors: Gerhard Kuss, Wetzlar (DE); René Ohrisch, Pohlheim (DE); Harald Braun, Gruenberg (DE); Walter Baur, Gruendau (DE)

(73) Assignee: Rovema Verpackungsmaschinen GmbH, Fernwald (DE)

( * ) Notice: Subject to any disclaimer, the term of this patent is extended or adjusted under 35 U.S.C. 154(b) by 121 days.

(21) Appl. No.: 09/726,264

(22) Filed: Nov. 30, 2000

(65) Prior Publication Data

US 2001/0005979 A1 Jul. 5, 2001

(30) Foreign Application Priority Data

Dec. 1, 1999 (DE) ..... 199 57 891

(51) Int. Cl.[7] ..... B65B 9/20

(52) U.S. Cl. ..... 53/551; 53/451; 53/552; 493/189; 493/302; 493/308

(58) Field of Search ..... 53/451, 471, 551, 53/552, 553, 554, 555; 493/89, 156, 167, 189, 193, 215, 308, 302

(56) References Cited

U.S. PATENT DOCUMENTS 1,986,422 A * 1/1935 Zwoyer ..... 53/131.5
2,899,875 A * 8/1959 Leasure ..... 53/551
3,091,902 A * 6/1963 Reinhardt et al. ..... 53/451
3,505,779 A * 4/1970 Kopp ..... 53/550
3,785,112 A * 1/1974 Leasure et al. ..... 53/551
4,442,656 A * 4/1984 Wylie, Sr. ..... 53/552
5,561,966 A * 10/1996 English ..... 53/412
5,862,652 A * 1/1999 Schoeler ..... 53/551

FOREIGN PATENT DOCUMENTS

IT 01274100 7/1997

* cited by examiner

*Primary Examiner*—Rinaldi I. Rada
*Assistant Examiner*—Thanh Truong
(74) *Attorney, Agent, or Firm*—Flynn, Thiel, Boutell & Tanis, P.C.

(57) ABSTRACT

A tubular bagging machine in which expanding elements projecting away from the fill pipe are provided in order to create bags with welded edges. A separate longitudinal welding device for welding of an area adjacent to the edge of the tube is provided. It is thus possible to produce directly side-by-side a longitudinal seam and a welded edge. A bag-opening aid or a reclosing aid can be integrated into the longitudinal seam or the edge.

13 Claims, 6 Drawing Sheets

TUBULAR BAGGING MACHINE

FIELD OF THE INVENTION

The invention relates to a tubular bagging machine comprising a foil web, a storage roller, guide rollers for feeding the flat foil web to an asymmetrical forming shoulder, whereby the front collar parts of the forming shoulder have different lengths, a foil removing means to transport the foil web, a fill pipe to receive the foil web, which has been shaped into a foil tube, jaws of a transverse welding device for creating cross-seams, a separating device for separating the foil tube, and flat expanding elements connected to the fill pipe and extending away from the fill pipe, whereby an edge-welding device is provided for each expanding element in a foil transport direction arranged downstream of the expanding elements, each edge-welding device being directed against the edge of the tube deflected by each respective expanding element.

BACKGROUND OF THE INVENTION

Such a known tubular bagging machine is used to manufacture tubular bags, the four edges of which are welded. These tubular bags have a relatively good stability. By using the asymmetrical forming shoulder the longitudinal seam, which otherwise extends centrally with respect to the bag, is offset to one edge of the bag so that a separate longitudinal seam no longer exists.

In another known tubular bagging machine a longitudinal seam, which is arranged centrally with respect to the bag, is created by means of a symmetrical forming shoulder. The edges of the bag are separately welded so that a bag has five longitudinally extending welding seams.

Whereas a bag with merely four longitudinally extending welding seams does not have a longitudinal seam, which interferes with the printing on the bag, a common, symmetrical forming shoulder can be used for the manufacture of a bag with a central longitudinal seam.

The known tubular bagging machines do not offer the possibility of manufacturing bags with opening aids or reclosing aids, which are easy to handle, so that this aid utilizes the special shape of the bag welded along its four edges.

SUMMARY OF THE INVENTION

The basic purpose of the invention is to overcome these disadvantages.

The purpose is attained by providing a separate longitudinal welding device for a welding of the area adjacent to the edge of the tube.

The invention has the advantage that because of the two welding devices, which are provided at one edge of the tube, namely an edge-welding device and the separate longitudinal welding device, two longitudinal seams are created directly side-by-side in the area of the tubular edge, where the foil tube is being longitudinally closed. One of these two longitudinal seams can be a seam which is relatively easy to open and cannot be closed again, and the other seam can be used as a seam which can be easily opened or again closed. Or, however, one seam fulfills due to its edge welding first of all the purpose of stabilizing the bag and the other seam is used to securely close the bag. Then the seam, which, for example, welds the edges, has generally less strength than the longitudinal seam welding the bags.

A so created bag has special importance also when the outer seam, namely the seam to be opened first, is a seam to be opened in a simple manner, and the following seam fulfills the function of the edge stabilization. The seam to be opened first can hereby be equipped with a reclosing aid.

When the longitudinal welding device is shifted with respect to the edge-welding device, which is adjacent to it, toward the edge of the foil, then the longitudinal welding device causes the closure of the foil tube at the point where the two edges of the foil meet. An edge area follows these edges. This arrangement permits in a simple manner the creation of bags welded at four edges with a longitudinal seam defined by one edge. The edge can hereby also be designed without a bag-closing characteristic.

The suggested tubular bagging machine is used for both the manufacture of bags, the edge of the foil of which extends away from the bag (foil tube) in the form of a fin, and also for bags, the edge of the foil of which rests on the bag (foil tube) in the form of an overlapping seam or a fin. The edge of the foil resting on the bag can be accomplished, for example, by means of a suitable welding.

The tubular bagging machine can be operated continuously or cyclically. The foil removing means is operated accordingly. Rotating endless bands and a rotating system of cross-jaws are suitable for a continuous longitudinal welding operation. Hot-sealing jaws, which are cyclically operated, can be utilized during a cycled operation.

Side-fold producers are used to create side folds in the foil tube. A pair of side-fold producers, which can be moved toward one another is utilized to create two opposing side folds in the foil tube. Thus tubular bags are welded with two opposing cross-seams each by means of two pairs of side-fold producers, whereby one pair is provided in foil transport direction in front of the transverse welding device and one pair downstream of the transverse welding device. These bags are very inherently stable. They are welded at the top and bottom by means of cross-seams. The side folds are welded into the cross-seams. When the distance of the one pair from the transverse welding device is equal to the distance of the other pair from the transverse welding device, then the bag is symmetrical with respect to its side-fold arrangement and can be shaped relatively round in order to have, when set on edge, a can-like appearance and to serve advantageously as a can replacement (material savings).

When the forming shoulder has a lateral slot, through which the edge of the foil is guided, then the tubular bagging machine can be equipped with a common, however, slotted, asymmetrical forming shoulder.

A preshaping of the edges can occur in a technically very simple manner independent of the type of operation of the tubular bagging machine when two foil hold-back means are provided in the area of the forming shoulder, which foil hold-back means are each arranged between two foil expanders in order to preshape the foil tube for a welding of the edges. These foil expanders are mounted on the fill pipe for an assured preshaping.

When a device for mounting of a bag-opening aid or a reclosing aid is mounted on the flat foil web, and when this aid is intended for introduction into the longitudinal seam and/or the edges to be welded, then a selected seam can be equipped with a suitable aid. As an aid is suited in particular (a) a strip-shaped peel layer in order to achieve an easy opening, (b) an adhesive strip with adhesive on both sides in order to achieve a secure lock in connection with a reclosing ability, and (c) an openable and recloseable structure in strip form in order to be able to achieve in particular repeated openings and closings of the bag.

BRIEF DESCRIPTION OF THE DRAWINGS

The created tubular bags and the tubular bagging machine of the invention will be described in greater detail hereinafter in connection with the drawings which illustrate exemplary embodiments and in which.

DETAILED DESCRIPTION

Figure 1:
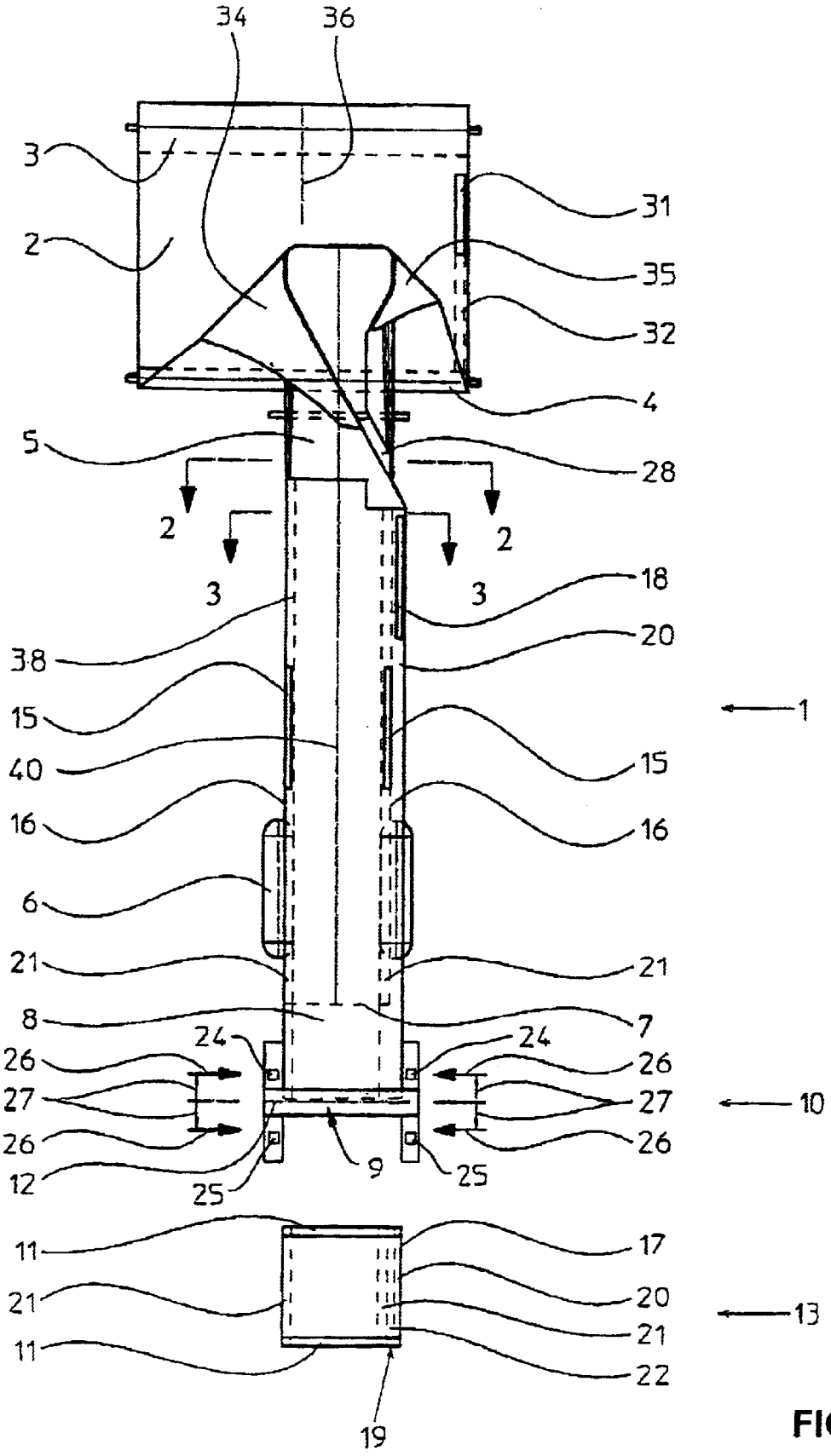
FIG. 1 is a side view of the principle of a tubular bagging machine for producing a tubular bag comprising an asymmetrical forming shoulder for shaping a flat foil web into a foil tube, a tapered fill pipe, flat expanding elements, closed, rotating jaws of a transverse welding device, with edge-welding devices directed against the deflected edges of the tube, and a separate longitudinal welding device.

A flat foil web 2 is in a vertical tubular bagging machine 1 unwound from a storage roller 3 and is fed over a guide roller 4 to an asymmetrical forming shoulder 5 (FIG. 1). The front collar parts 34, 35 of the forming shoulder 5 have different lengths. A foil removing means 6 is used to further transport the foil web 2 along a transport path 38, which has a longitudinal axis 40. Fill pipe 7 receives the foil web 2, which has been formed into a foil tube 8. Jaws 9 of a transverse welding device 10, which jaws can be moved toward one another into and out of the plane of the drawing of FIG. 1, are used to produce cross-seams 11 on the foil tube 8. A separating device 12 is housed in one of the jaws 9 in order to cut the foil tube 8 at each cross-seam 11. The produced bags 13 are filled through the fill pipe 7.

Figure 2:
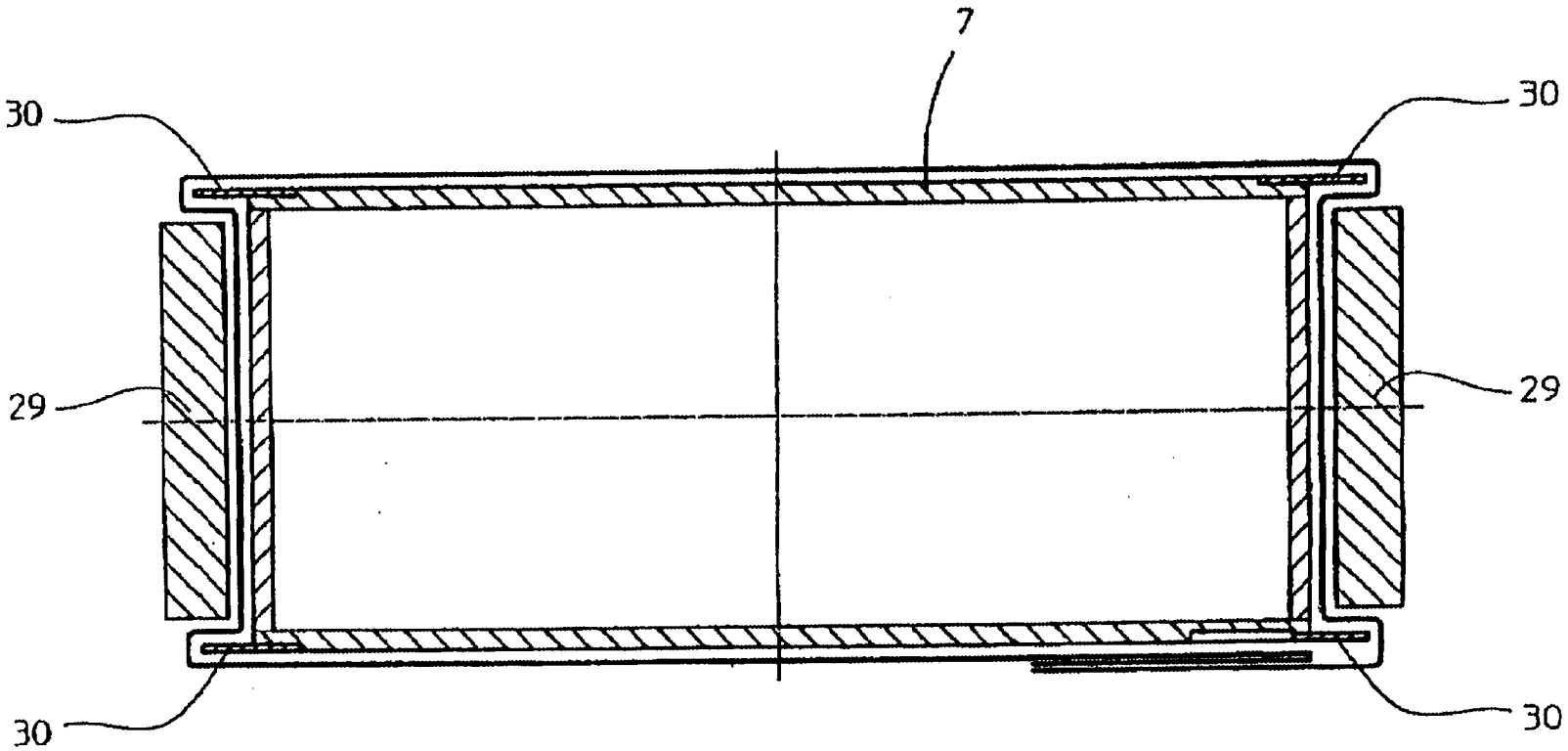
FIG. 2 is a cross-sectional view taken along the line 2–2 of FIG. 1 of the fill pipe with four foil expanders and a foil expanders and a foil hold-back means between two foil expanders.
Figure 3:
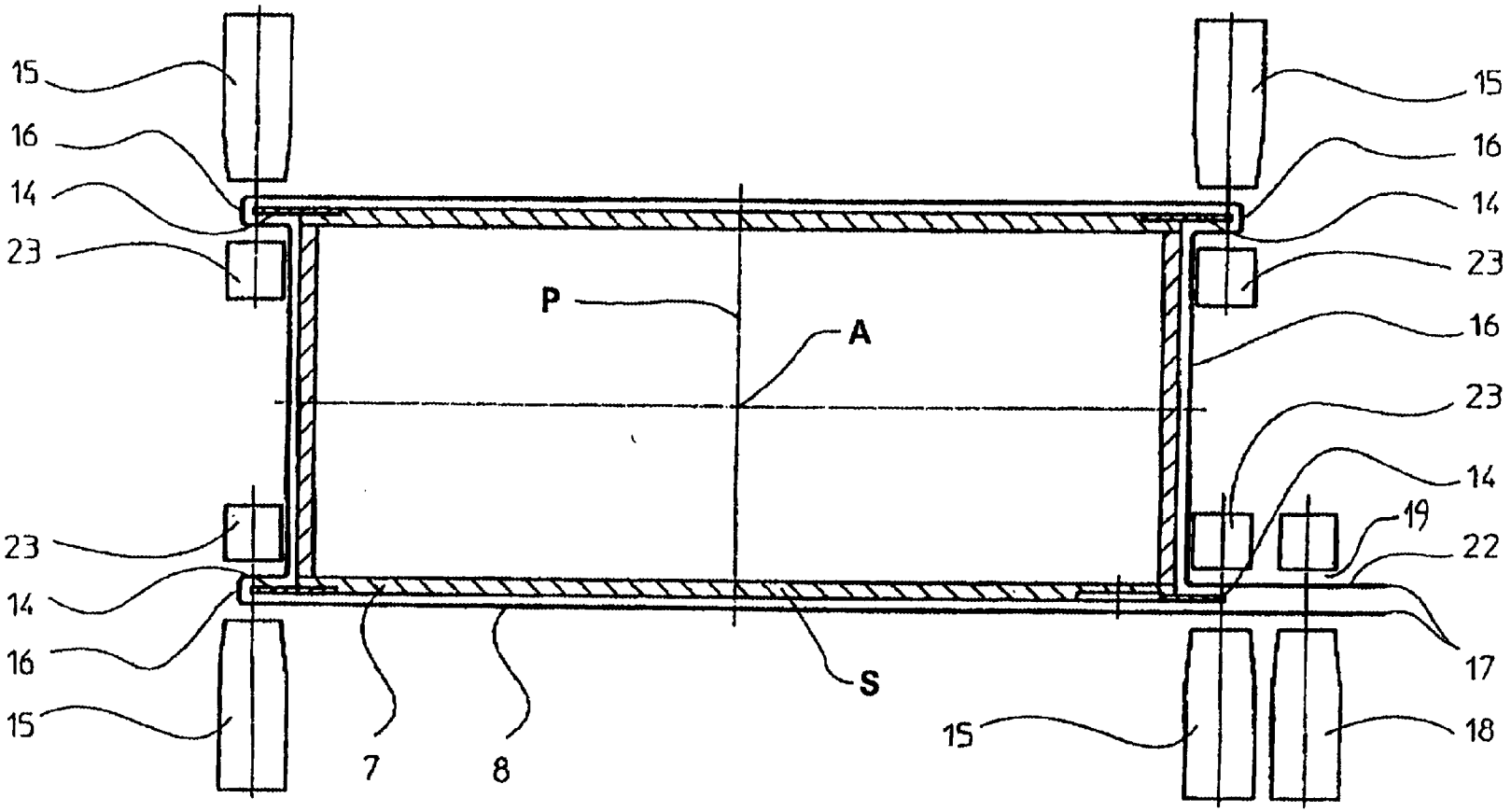
FIG. 3 is a cross-sectional view taken along the line 3–3 of Fig. 1 of the fill pipe with four expanding elements, an edge-welding device per expanding element, and a separate, additional longitudinal welding device on the edge of the tube.
Figure 4:
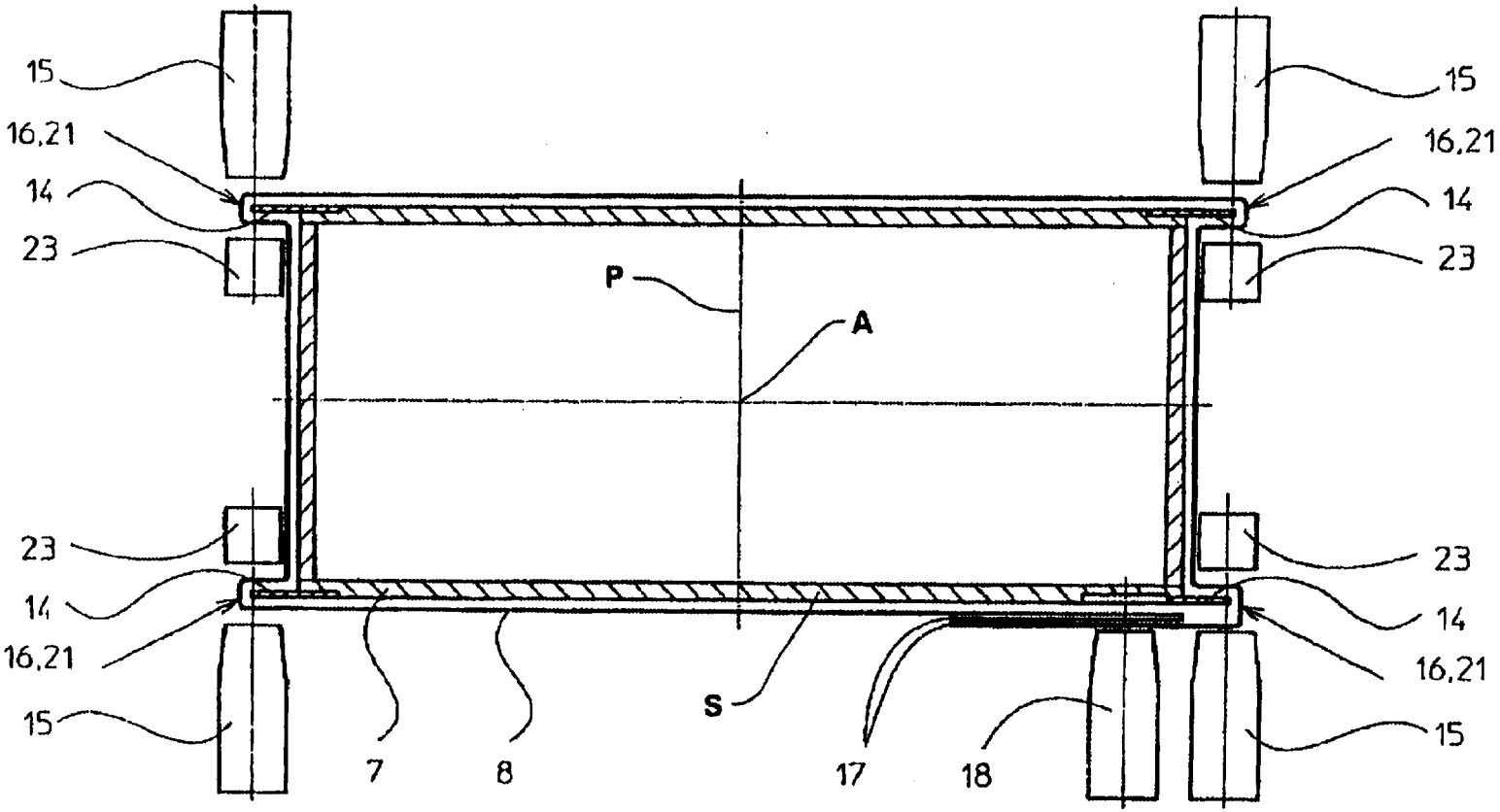
FIG. 4 is a cross-sectional view of a subject matter analogous to FIG. 3, however, with a folded edge of the tube and a shifted, modified longitudinal welding device.

Four flat expanding elements 14 (FIG. 3) projecting away from the fill pipe 7 are connected to the fill pipe 7. As shown in FIGS. 2–4, the cross section of the fill pipe 7 has plural corners. In a preferred embodiment disclosed herein, the plural corners define a rectangle. The expanding elements 14 are each secured to the fill pipe 7 at a corner thereof and extend planes that are parallel to each other and, in this particular embodiment, parallel to the plane containing the sidewall S. An edge-welding device 15 is provided for each expanding element 14 in a foil-transport direction downstream of the expanding elements 14, namely below the expanding elements 14, each edge-welding device being directed against an edge of the tube 16 deflected by a respective expanding element 14.

The forming shoulder 5 shifts the edges 17 of the foil resting on one another to the right (FIG. 3) to the side of the foil tube 8, namely, away from a distal edge of one expanding element 14 and a theoretical plane P (FIG. 3) containing a central longitudinal axis A of the fill pipe 7 and which intersects a sidewall S of the fill pipe. In FIGS. 3 and 4, the plane P extends perpendicular to the sidewall S. A separate longitudinal welding device 18 is provided for welding the area 19 adjacent to the edge 17 of the tube 16 in order to create two directly side-by-side positioned welding seams 20, 21. The longitudinal welding device 18 produces a longitudinal seam 20, whereas each edge-welding device 15 produces a welded edge 21 on the foil tube 8. The longitudinal welding device 18 is shifted, with respect to the edge-welding device 15 adjacent to it, toward the edge of the foil 17. The edge of the foil 17 projects in the form of a fin 22 projecting away from the foil tube 8.

The foil removing means 6 is continuously operated. The longitudinal welding device 18 and the edge-welding devices 15 are continuously driven, endless bands. The edge-welding devices 15 each have one bracket 23.

Two pairs 24, 25 of side-fold producers 26 are provided on the transverse welding device 10. The two side-fold producers 26 of one pair 24, 25 are moved against one another (toward one another) and into the foil tube 8, which is between them, in order to create side folds in the bag 13. One pair 24 is provided in foil transport direction in front of the transverse welding device 10 and one pair 25 is provided after the transverse welding device 10. The distance 27 of the one pair 24 from the transverse welding device 10 is, viewed in foil transport direction, equal to the distance 27 of the other pair 25 from the transverse welding device 10.

The forming shoulder 5 has a lateral slot 28, through which the edge 17 of the foil is guided to the outside (FIG. 1). Two foil hold-back means 29 are provided on the fill pipe 7 in the area of the forming shoulder 5, which foil hold-back means are each arranged between two foil expanders 30, in order to preshape the foil tube 8 for a welding of the edges 21.

Figure 5:
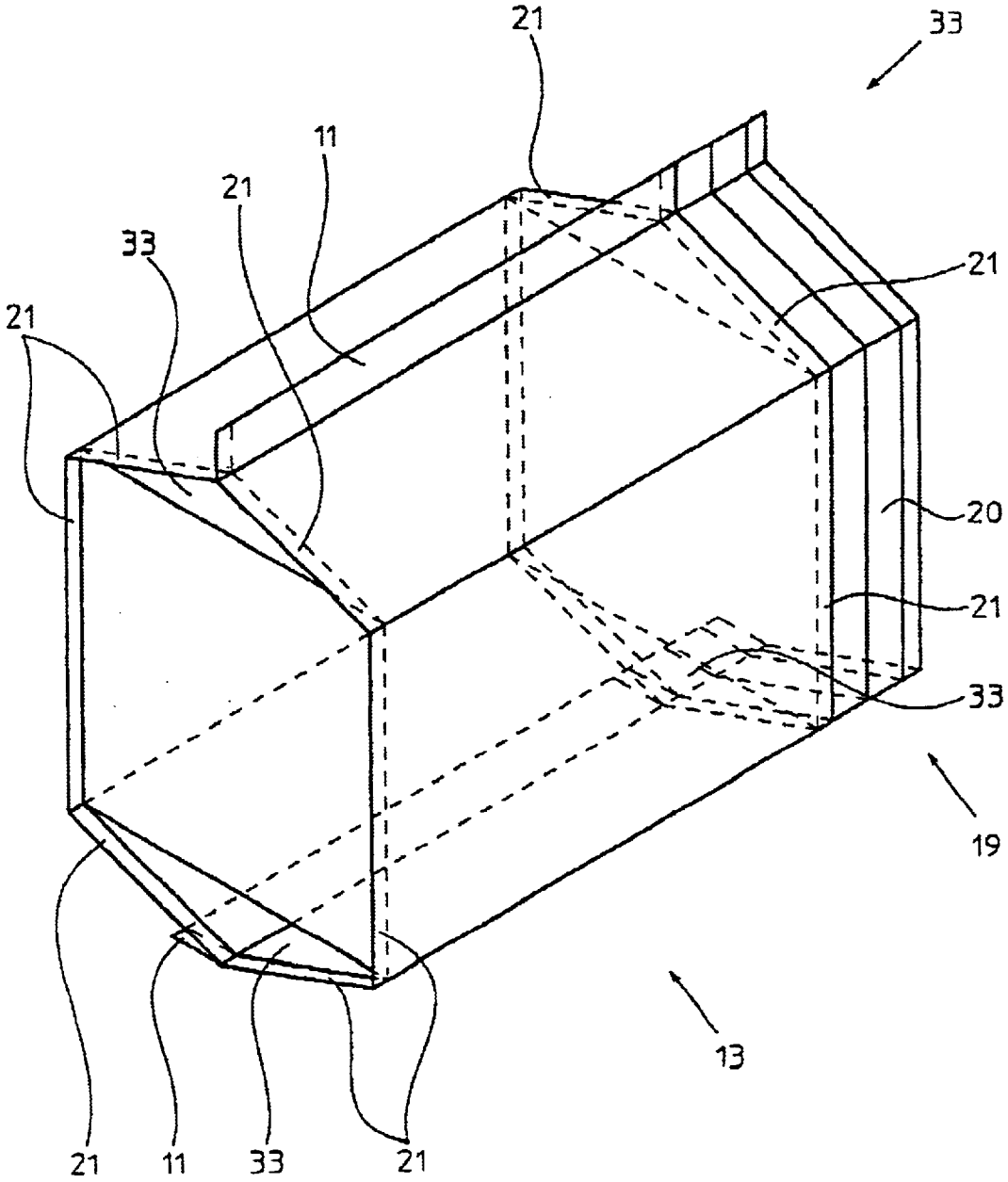
FIG. 5 is a perspective illustration of a tubular bag with two side folds per each side and with welded edges provided on each of the two edges of the two sides and extending parallel to the longitudinal seam.

A device 31 for mounting of a bag-opening aid 32 is mounted on the flat foil web 2 (FIG. 1). The bag-opening aid 32 is a strip-shaped peel layer which runs into the longitudinal seam 20 and is used to make opening of a so created bag 13 (FIG. 5) easier.

The bag 13 has four side folds 33 and is closed off at each of the top and the bottom by means of a cross-seam 11. A longitudinal seam 20 extends next to one of its welded edges 21. Its fin 22 projects from the bag 13. The peel layer 32 within the longitudinal seam 20 enables an easy opening of the longitudinal seam 20 by pulling.

Figure 6:
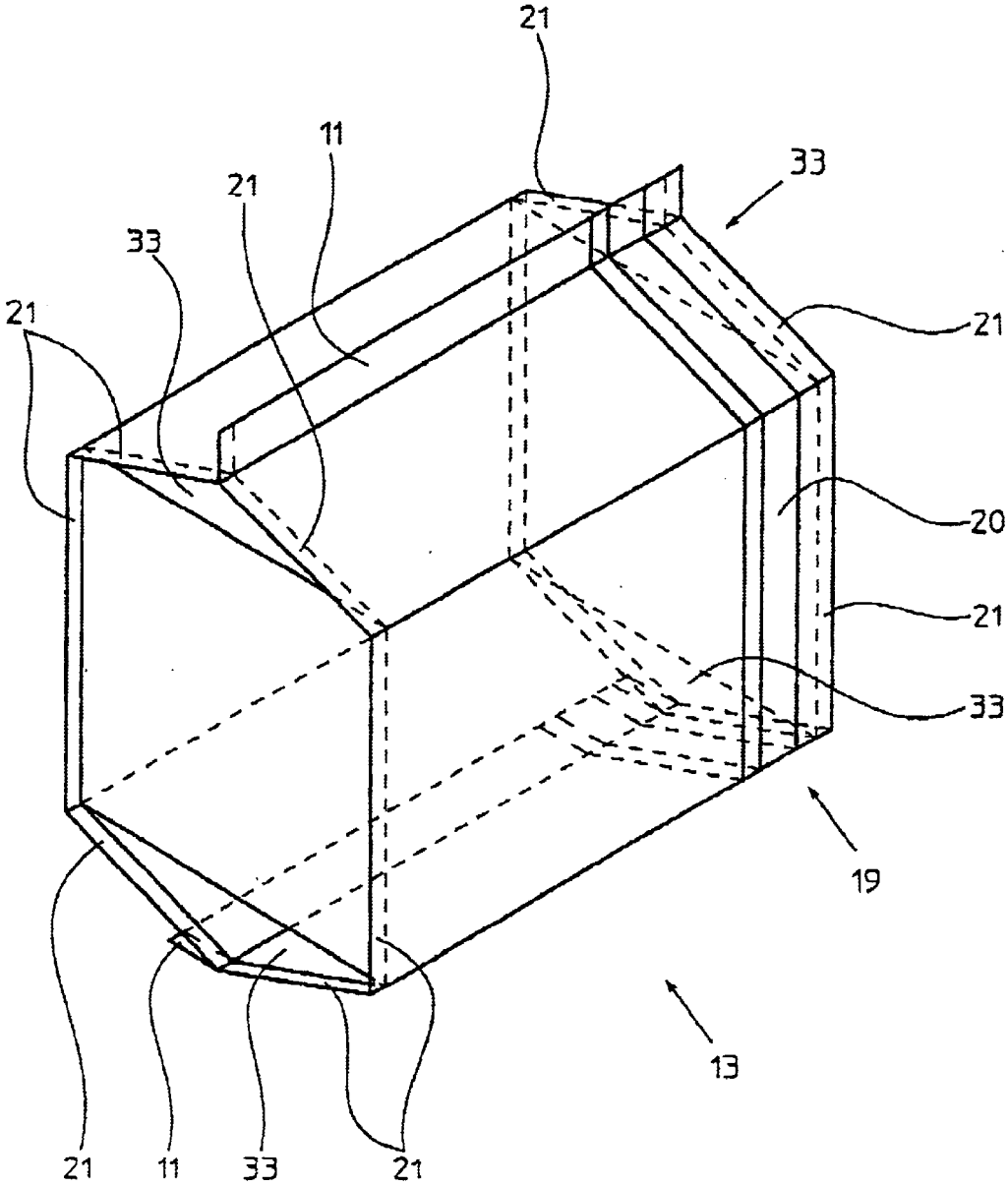
FIG. 6 is a perspective illustration of a tubular bag analogous to FIG. 5, however, with a folded edge area of the bag.

The bag 13 according to FIG. 6 can be created by means of an arrangement of the longitudinal welding device 18 according to FIG. 4, namely, wherein the folded fin 22 extends away from the distal edge of the expanding element 14 and toward the theoretical plane P to overlay the sidewall S. The longitudinal welding device 18 acts here against the folded fin 22 and against the fill pipe 7. The respective bag 13 has thus a folded longitudinal seam 20.

The created bags 13 (FIGS. 5, 6) can be set on the edges 21, where the longitudinal seam 20 does not exist. It is then possible to open the longitudinal seam 20, which lies on top, in order to remove product from the bag 13. The edges 21 stabilize the bag 13. It is also possible to tightly close off the edge 21 adjacent to the longitudinal seam 20 and an adhesive strip with adhesive on both sides or a zip-lock strip could be provided in the longitudinal seam 20 in order to easily again close the bag 13. As an alternative it is also possible to fixedly weld the longitudinal seam 20 and to provide the adjacent edge 21 with a reclosing aid. The device 31 for mounting the bag opening aid would then have to be shifted slightly to the center 36 of the foil web 2.

What is claimed is:

1. A tubular bagging machine for forming a bag, comprising:

a flat foil web having two laterally spaced edges carried on a storage roller;

at least one guide roller for feeding the flat foil web to an asymmetrical forming shoulder, the asymmetrical forming shoulder including collar parts which have different length and are positioned to form the flat foil web into a foil tube wherein the two laterally spaced edges become mutually adjacent and overlapping;

a fill pipe positioned along a transport path and downstream of the forming shoulder, the fill pipe having plural corners, the mutually adjacent and overlapping edges of the foil web being oriented by the asymmetrical forming shoulder at one corner of the fill pipe to define a fin at the one corner that projects one of (a) away from the corner and a theoretical plane containing a central longitudinal axis of the fill pipe and intersecting a sidewall of the fill pipe intermediate the one corner and a next adjacent corner and (b) away from the corner toward the theoretical plane to overlay the sidewall;

a foil removing means configured to transport the foil tube along the transport path, said transport path having a longitudinal axis coextensive with the central longitudinal axis of the fill pipe;

a longitudinal welding device provided downstream of the forming shoulder and aligned with the mutually adjacent and overlapping edges for forming a first longitudinal seam thereat;

plural expanding elements positioned downstream of said first longitudinal welding device, each of the expanding elements being configured to deflect the foil tube away from the central longitudinal axis and into an overlapping relation to form an edge at a plurality of corners of the fill pipe;

plural edge welding devices positioned along the transport path downstream of the expanding elements and corresponding in number to the number of plural expanding elements, each of the plural welding devices being configured to be directed against the corresponding deflected edge of the foil tube to form a second longitudinal welding seam at each of the plural edges, one of the plural edge welding devices being offset out of alignment with the longitudinal welding device so that one of the second longitudinal welding seams produced by the one of the plural edge welding devices is oriented offset from and along side of the first longitudinal seam; and a transverse welding device positioned along the transport path downstream of the plural edge welding devices and including first and second jaws configured to create a cross seam in the foil tube, wherein a separating device is included in at least one of the first and second jaws and is configured to separate the foil tube along the cross seam.

2. The tubular bagging machine according to claim 1, wherein each edge of the foil formed by the expanding elements projects away from the foil tube in the form of a fin.

3. The tubular bagging machine according to claim 1, wherein the foil removing means is configured to be continuously driven, and wherein both the longitudinal welding device and the edge-welding devices are mounted on continuously driven endless bands.

4. The tubular bagging machine according to claim 1, wherein the foil removing means is configured to be cyclically operated, and both the longitudinal welding device and the edge-welding devices are correspondingly cyclically moved in sync with the foil tube.

5. The tubular bagging machine according to claim 1, wherein first and second pairs of side-fold producers are provided on the transverse welding device along the transport path, the first and second pairs of side-fold producers being moveable toward one another and into the foil tube provided between them in the transport path, and further wherein the first pair is positioned upstream of the transverse welding device and the second pair is positioned downstream of the transverse welding device.

6. The tubular bagging machine according to claim 5, wherein a distance between the first pair of side-fold producers and the transverse welding device is equal to a distance between the second pair of side-fold producers and the transverse welding device.

7. The tubular bagging machine according to claim 1, wherein the forming shoulder has a lateral slot through which at least one of the laterally spaced edges of the foil is guided.

8. The tubular bagging machine according to claim 1, wherein two foil hold-back means are provided in the area of the forming shoulder, which foil hold-back means are each arranged between two flat foil expanding elements in order to preshape the foil tube for a welding of the edges formed by the plural edge welding devices.

9. The tubular bagging machine according to claim 1, wherein the flat foil expanding elements are mounted on the fill pipe.

10. The tubular bagging machine according to claim 1, wherein a device for mounting a bag-opening aid and/or reclosing aid is mounted on the forming shoulder, and for introduction into at least one of the longitudinal seam formed by the longitudinal welding device and one of the plural seams formed by the plural edge welding devices.

11. The tubular bagging machine according to claim 10, wherein the bag-opening and/or reclosing aid is at least one of a strip-shaped peel layer, an adhesive strip with adhesive on both sides, and an openable and recloseable lock strip.

12. The tubular bagging machine according to claim 1, wherein the plural corners of the fill tube define a rectangle.

13. The tubular bagging machine according to claim 1, wherein the fin projects away from a distal edge of one of plural expanding elements at the one corner.

* * * * *

UNITED STATES PATENT AND TRADEMARK OFFICE

CERTIFICATE OF CORRECTION

PATENT NO. : 6,729,112 B2
DATED : May 4, 2004
INVENTOR(S) : Gerhard Kuss et al.

It is certified that error appears in the above-identified patent and that said Letters Patent is hereby corrected as shown below:

Column 6,
Line 39, change "claim 1" to -- claim 8 --.

Signed and Sealed this

Twenty-eighth Day of September, 2004

JON W. DUDAS
*Director of the United States Patent and Trademark Office*